US010325578B1

(12) United States Patent
Bergman et al.

(10) Patent No.: US 10,325,578 B1
(45) Date of Patent: Jun. 18, 2019

(54) MUSICAL INSTRUMENT

(71) Applicant: Wheely Enterprises IP, LLC, Camarillo, CA (US)

(72) Inventors: Eric C. Bergman, Camarillo, CA (US); Daniel K. Peyton, Santa Rosa Valley, CA (US)

(73) Assignee: Wheely Enterprises IP, LLC, Camarillo, CA (US)

( * ) Notice: Subject to any disclaimer, the term of this patent is extended or adjusted under 35 U.S.C. 154(b) by 0 days.

(21) Appl. No.: 16/116,144

(22) Filed: Aug. 29, 2018

Related U.S. Application Data

(63) Continuation-in-part of application No. 15/348,475, filed on Nov. 10, 2016, now abandoned.

(60) Provisional application No. 62/253,462, filed on Nov. 10, 2015.

(51) Int. Cl.

| | |
|---|---|
| ***G10H 1/32*** | (2006.01) |
| ***G10H 3/18*** | (2006.01) |
| ***G10G 5/00*** | (2006.01) |
| ***G10D 3/04*** | (2006.01) |
| ***G10D 3/14*** | (2006.01) |
| ***G10D 3/06*** | (2006.01) |
| ***G10D 3/10*** | (2006.01) |

(52) U.S. Cl.
CPC ..... *G10G 5/005* (2013.01); *G10D 3/04* (2013.01); *G10D 3/06* (2013.01); *G10D 3/10* (2013.01); *G10D 3/14* (2013.01)

(58) Field of Classification Search
CPC . G06F 1/16; G10D 3/06; G10D 1/085; G10D 3/00; G10D 1/005; G10D 1/00; G10H 3/18; G10H 1/00; G10H 1/32; G10H 1/342; G10H 3/12; G10C 3/06
See application file for complete search history.

(56) References Cited

U.S. PATENT DOCUMENTS

| | | | | |
|---|---|---|---|---|
| 1,769,304 | A * | 7/1930 | Paczkowski | G10D 3/02 84/275 |
| 2,124,243 | A * | 7/1938 | Carter | G10D 1/02 84/274 |
| 4,135,426 | A | 1/1979 | Rickard | |
| 4,616,548 | A | 10/1986 | Anderson | |
| 4,872,388 | A | 10/1989 | Gunn | |
| 4,919,033 | A * | 4/1990 | Markov | G10H 3/18 84/726 |
| 5,528,971 | A | 6/1996 | Wood | |
| 5,616,874 | A | 4/1997 | Kraus | |
| 5,977,462 | A | 11/1999 | Wolfson | |
| 6,809,245 | B2 | 10/2004 | Sawhney et al. | |
| D512,452 | S | 12/2005 | Sawhney et al. | |
| D516,606 | S | 3/2006 | Sawhney et al. | |

(Continued)

*Primary Examiner* — Marlon T Fletcher
(74) *Attorney, Agent, or Firm* — Hall Estill Attorneys at Law

(57) ABSTRACT

A musical instrument is provided. The musical instrument includes at least, but is not limited to, a core portion providing a neck, and headstock portions, a body portion attached to the core portion, the body portion including at least a relief, the relief configured to accommodate an arm of a chair, and a tuning structure secured to the headstock. The musical instrument further includes at least, but is not limited to, a plurality of strings secured to the tuning structure, a bridge portion communicating with the plurality of strings, and a pick up secured to the body portion and interacting with the plurality of strings.

20 Claims, 2 Drawing Sheets

(56) References Cited

U.S. PATENT DOCUMENTS

| | | | | |
|---|---|---|---|---|
| D518,504 | S | 4/2006 | Sawhney et al. | |
| D525,646 | S | 7/2006 | Sawhney et al. | |
| 7,230,174 | B1 | 6/2007 | Wilson | |
| 7,320,643 | B1 | 1/2008 | Brosius et al. | |
| 7,371,949 | B2 | 5/2008 | Sawhney et al. | |
| 7,687,696 | B2 | 3/2010 | Fox | |
| 8,710,337 | B1 * | 4/2014 | Gomes | G10D 3/02 84/294 |
| 9,123,314 | B2 * | 9/2015 | Creek | G10G 5/00 |
| 9,454,947 | B1 | 9/2016 | Hart et al. | |
| 2002/0100357 | A1 | 8/2002 | Williams | |
| 2003/0037659 | A1 * | 2/2003 | Wilson | G10D 3/146 84/291 |
| 2004/0244566 | A1 | 12/2004 | Steiger | |
| 2007/0163427 | A1 | 7/2007 | Rigopulos et al. | |
| 2009/0139385 | A1 | 6/2009 | Ngene | |
| 2009/0178535 | A1 * | 7/2009 | Peavey | G10D 1/08 84/267 |
| 2012/0011985 | A1 | 1/2012 | Kamensky | |
| 2013/0174717 | A1 | 7/2013 | Butera | |
| 2014/0076122 | A1 * | 3/2014 | Toyonaga | G10D 3/18 84/453 |
| 2014/0208920 | A1 | 7/2014 | Creek | |
| 2016/0163298 | A1 | 6/2016 | Butera | |

* cited by examiner

MUSICAL INSTRUMENT

RELATED APPLICATIONS

This application is a continuation-in-part of co-pending U.S. patent application Ser. No. 15/348,475 filed Nov. 10, 2016 which claims priority to U.S. Provisional Patent Application No. 62/253,462 filed Nov. 10, 2015, the contents of which are hereby incorporated by reference.

SUMMARY OF THE INVENTION

Embodiments of the present invention relate to musical instruments having a relief to accommodate an arm of a chair. Embodiments of the present invention allow a musician, confined to a wheelchair, to play the instrument in a natural, unfettered playing position. Embodiments of the present musical instrument includes at least, but is not limited to, a core portion providing a neck, and headstock portions, a body portion attached to the core portion, and a tuning structure secured to the headstock. The body portion including at least a first relief, the first relief configured to accommodate an arm of a chair, and a second relief, the second relief accommodating a leg of a musical instrument user. The musical instrument further includes at least, but is not limited to, a plurality of strings secured to the tuning structure, a bridge portion communicating with the plurality of strings, and a pick up secured to the body portion and interacting with the plurality of strings.

DETAILED DESCRIPTION

In the following description of preferred embodiments, reference is made to the accompanying drawings which form a part hereof, and in which are shown by way of illustration specific embodiments in which the invention may be practiced. It is to be understood that other embodiments may be utilized and structural changes may be made without departing from the scope of the preferred embodiments of the present invention.

Although the following description is directed primarily to a stringed musical instrument, such as, for example, a six string guitar, it is to be understood that embodiments of the present invention may be adapted to any musical instrument. For example, other types of guitars rather than a six string guitar may be adapted to embodiments of the present invention, such as, for example, 7-string guitars, 8-string guitars, 10-string guitars, twelve string guitars, tenor guitars, four string bass guitars, 5-string string bass guitars, 6-string bass guitars and the like. In addition, other stringed musical instruments may also be adapted to embodiments of the present invention, such as, for example, banjos, ukuleles, mandolins and the like, as well as the traditional orchestral stringed musical instruments, such as, for example, violins, violas, cellos and contrabasses.

Figure 1:
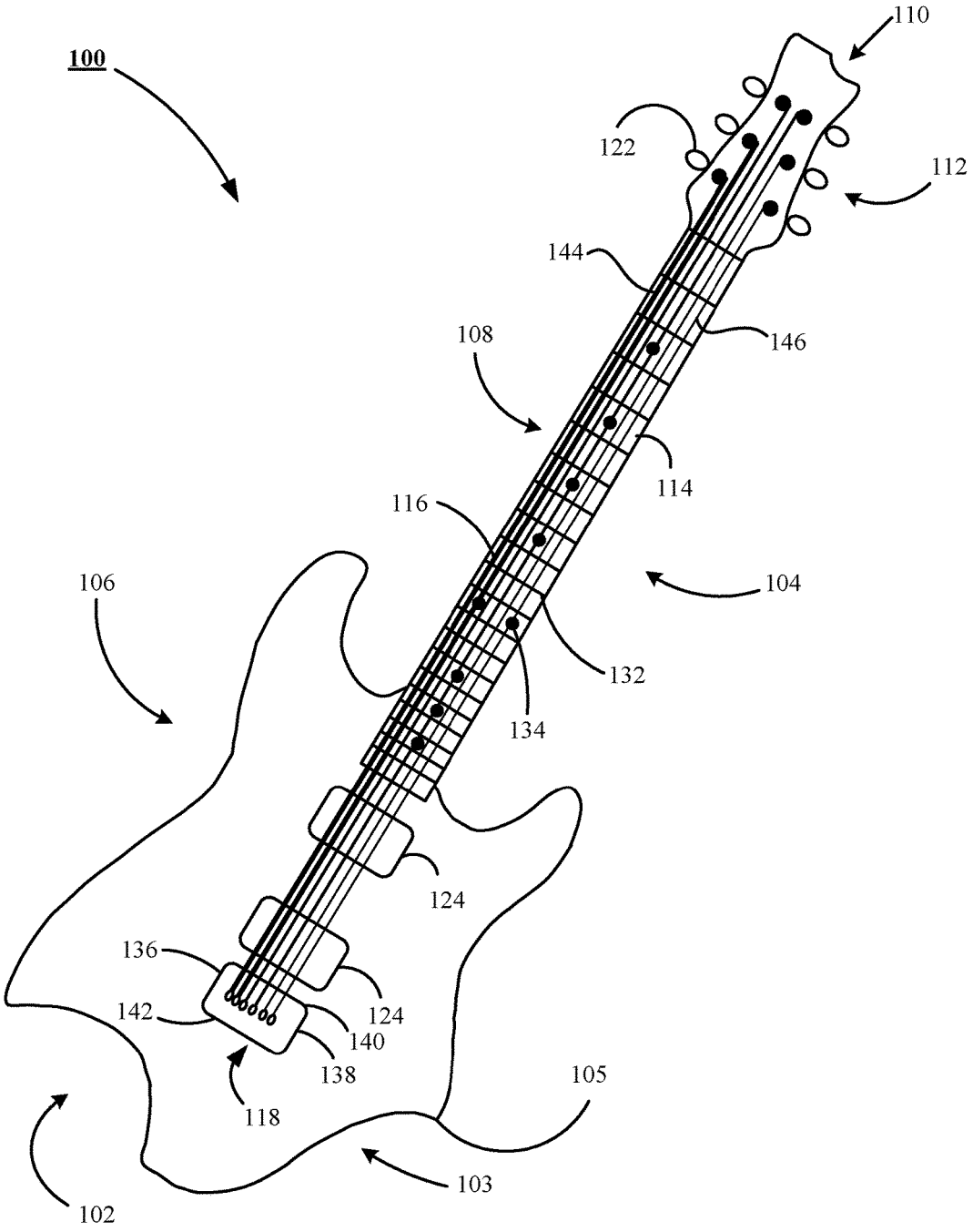
FIG. 1 shows a musical instrument having a relief to accommodate an arm of a chair.

A musical instrument 100 having a first relief 102, the relief 102 to accommodate an arm of a chair, and a second relief 103, the second relief accommodating a leg of a user of the musical instrument, according to an embodiment of the present invention is shown generally in FIG. 1. The musical instrument 100, having the first relief 102, to accommodate an arm of a chair, and the second relief 103 to accommodate the leg of a user seated in a chair with an arm, shown in FIG. 1, is a guitar and may include, for example, a core portion 104 and a body portion 106. The body portion 106 facilitates the first and second reliefs (102 and 103), while providing the support structure for the core portion 104. In a preferred embodiment, the core portion 104 provides a neck portion 108, and a headstock portion 110. Preferably, the headstock portion 110 supports a tuning mechanism 112, while the neck portion 108 supports a fretboard 114. Preferably, the arm of the chair is an arm of a wheelchair, the musical instrument 100, by way of the reliefs 102 and 103, is configured to allow a musician, confined to the wheelchair, to play the musical instrument 100 in a natural, unfettered playing position.

Preferably, the musical instrument 100 further includes a plurality of strings 116 secured to the tuning structure 112. The strings 116 are secured to a bridge portion 118, and in turn the bridge portion 118 is secured to the body portion 106 by way of bridge stays 120 (of FIG. 2). The bridge stays 120 extend through the body portion 106, from a back of the body portion 106, and connect to the bridge portion 118, to secure the bridge portion 118 to a front of the body portion 106.

In a preferred embodiment, the strings 116, of the musical instrument 100, interact with the tuning structure 112, which provides tuning pegs 122. The tuning pegs 122, through the application of a rotational force, apply a tensile load to the strings 116. The string 116 are secured to, and disposed between, the body portion 106, by way of the bridge portion 118, and the headstock portion 110, by way of the tuning structure 112.

Figure 2:
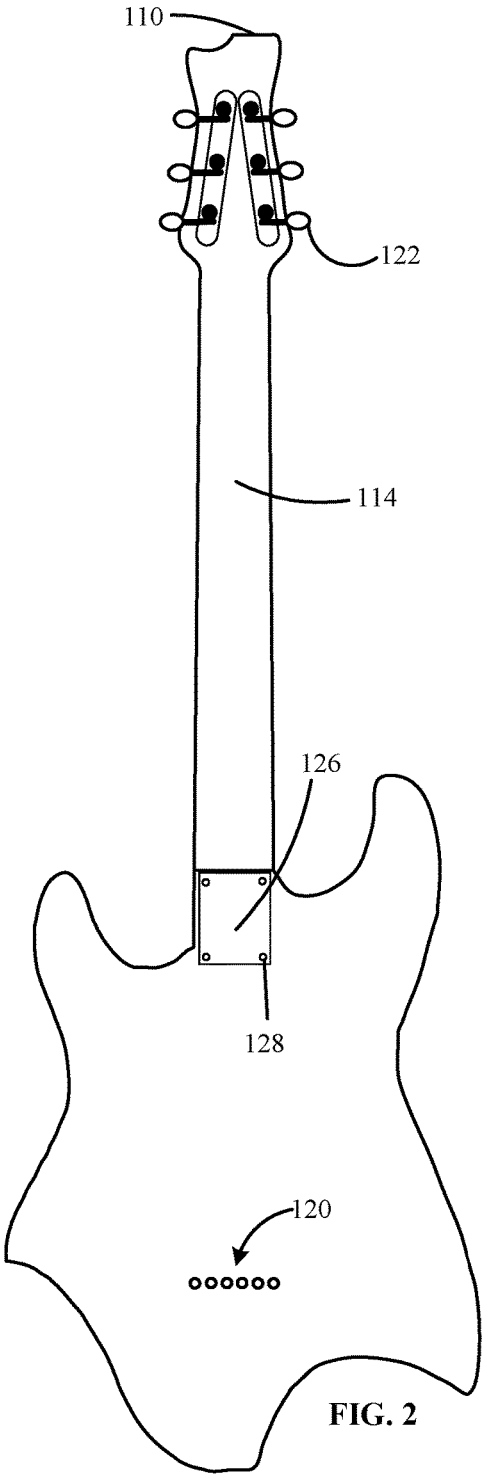
FIG. 2 shows side cross sectional view of the musical instrument of FIG. 1.

In a preferred embodiment, in which the musical instrument 100, is an electric guitar, the front of the body portion 106 supports a pair of pickups 124, which are provided to pick up vibrations of the strings 116, and feed those vibrations, in the form of a signal, to an amplifier, while the back of the body portion 106, supports an anchor plate 126. The anchor plate 126, traverses a union of the neck portion 108 with the body portion 104, as shown by FIG. 2, and provides structural stability to the musical instrument 100. To facilitate this structural support, a preferred embodiment includes a plurality of fasteners 128, also referred to herein as neck screws 128, which extend through the anchor plate 126 to securely fasten the neck portion 108 to the body portion 106.

Figure 3:
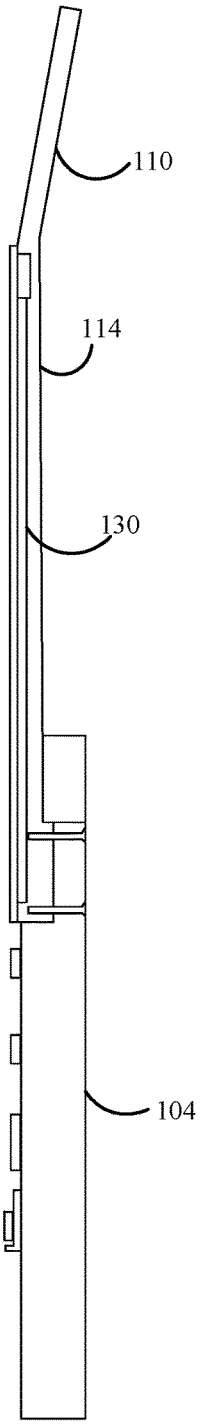
FIG. 3 shows a back view of the musical instrument of FIG. 1.

Turning to FIG. 3, as shown therein, the preferred embodiment includes a truss rod 130, disposed between the headstock portion 110, and the body portion 106. Preferably the truss rod 130, is enclosed within the neck portion 108, and provides additional rigidity to the neck portion 106, to offset the strain being applied to the neck portion 106 by the strings 116 (of FIG. 1).

Returning to FIG. 1, the fretboard 114, secured to the neck portion 108, and disposed between the headstock portion 110 and the body portion 110, provides a plurality of frets 132, which are supported by the fretboard 114 and disposed between the headstock portion 110 and the body portion 106. The fretboard preferably further supports a plurality of position markers 134, embedded in the fretboard 114, and disposed between the headstock portion 110, and the body portion 106. Further, the bridge portion 118, includes at least an upper portion 136, a lower portion 138, a left end 140, and a right end 142. The upper portion 136, supports an $E_4$ string 144, of the plurality of strings 116. The lower portion 138, supports an $E_2$ string 146, of the plurality of strings 116. The left end 140, is positioned beneath the plurality of strings 116, and most proximal the headstock 110. The right end 142, of the bridge portion 118, is an end of the bridge portion 118, most distal from the headstock 110. The first relief 102, is adjacent the upper portion 136, of the bridge portion 118, and the second relief 103, is adjacent the lower portion 138, of the bridge portion, 118. Both the first and the second relief portions 102, 103, are further presented at the end of the body portion 106, most distal from the left end 140, of the bridge portion 118, which is the end of the bridge portion 118, most proximal the headstock 110.

While particular embodiments of the present invention have been shown and described, it will be obvious to those skilled in the art that the invention is not limited to the particular embodiments shown and described and that changes and modifications may be made without departing from the spirit and scope of the appended claims.

What is claimed is:

1. A musical instrument structurally configured to accommodate a disabled user, the musical instrument comprising:

a core portion providing neck, and headstock portions;

a body portion attached to the core portion, the body portion comprising a first relief, and a bridge portion, the first relief configured to accommodate an arm of a chair, the bridge portion secured to the body portion;

a tuning structure secured to the headstock portion;

a second relief provided by the body portion, the second relief configured to accommodate a leg of an instrument user seated the chair having the arm, the second relief is a separate and distinct structural element of the musical instrument from the first relief structural element of the musical instrument; and a plurality of strings secured to the tuning structure, and in which the first relief and the second relief are opposed one another relative to the strings, and presented at an end of the body portion most distal from the headstock portion, and further in which the bridge portion comprises: an upper portion; a lower portion; a left end; and a right end, the upper portion supports an $E_4$ string of the plurality of strings, the lower portion supports an $E_2$ string of the plurality of strings, the left end is positioned beneath the plurality of strings and most proximal the headstock, the right end of the bridge portion is an end of the bridge portion most distal from the headstock, the first relief adjacent the upper portion of the bridge portion, the second relief adjacent the lower portion of the bridge portion, both the first and the second relief portions are further presented at the end of the body portion most distal from the left end of the bridge portion, which is the end of the bridge portion most proximal the headstock, and in which the chair is a wheel chair, the musical instrument is a guitar, and further wherein provided first and second reliefs are structurally configured to accommodate an arm of the wheel chair and a leg of a wheel chair bound guitar user.

2. The musical instrument of claim 1, wherein the guitar is an electric guitar.

3. The musical instrument of claim 1, further comprising the bridge portion communicating with the plurality of strings, the plurality of strings secured to the tuning structure, and in which the guitar is an acoustic guitar.

4. The musical instrument of claim 1, further comprising a pick up secured to the body portion and interacting with a plurality of strings, the plurality of strings secured to the tuning structure.

5. The musical instrument of claim 1, further comprising an anchor plate communicating with a back of the body portion and traversing a union of the neck portion with the body portion, and in which the guitar is an acoustic bass guitar.

6. The musical instrument of claim 1, further comprising a fastener interacting with an anchor plate, body portion, and the neck portion, the fastener secures the neck portion to the body portion, the anchor plate communicating with a back of the body portion and in which the guitar is an electric bass guitar.

7. The musical instrument of claim 1, further comprising a truss rod disposed between the headstock portion and the body portion, and enclosed within the neck portion.

8. The musical instrument of claim 1, further comprising a tuning peg interacting with the tuning structure, the tuning peg applying a tensile load to a string, the string secured to, and disposed between, the body portion and the headstock portion.

9. The musical instrument of claim 1, further comprising a plurality of bridge stays, each bridge stay in communication with a back of the body portion, and interacts with a bridge portion, the bridge portion mounted on a front of the body portion.

10. The musical instrument of claim 1, further comprising a fretboard secured to the neck portion, and disposed between the headstock portion and the body portion.

11. The musical instrument of claim 1, further comprising a plurality of frets supported by a fretboard and disposed between the headstock portion and the body portion, the fretboard secured to the neck portion.

12. The musical instrument of claim 1, further comprising a plurality of position markers embedded in a fretboard and disposed between the headstock portion and the body portion, the fretboard secured to the neck portion.

13. The musical instrument of claim 1, in which the arm of the chair is an arm of a wheelchair, the musical instrument is configured to allow a musician, confined to the wheelchair, to play the instrument in a natural, unfettered playing position.

14. The musical instrument of claim 13, further comprising a bridge portion communicating the plurality of strings.

15. The musical instrument of claim 14, further comprising a pick up secured to the body portion and interacting with the plurality of strings.

16. The musical instrument of claim 15, further comprising an anchor plate communicating with a back of the body portion and traversing a union of the neck portion with the body portion.

17. The musical instrument of claim 16, further comprising a fastener interacting with the anchor plate, body portion, and the neck portion, the fastener secures the neck portion to the body portion.

18. The musical instrument of claim 17, further comprising a truss rod disposed between the headstock portion and the body portion, and enclosed within the neck portion.

19. The musical instrument of claim 18, further comprising a tuning peg interacting with the tuning structure, the tuning peg applying a tensile load to the string, the string secured to the body portion and the headstock portion.

20. The musical instrument of claim 19, further comprising a plurality of bridge stays, each bridge stay in communication with the back of the body portion, and interacts with the bridge, the bridge mounted on a front of the body portion.

* * * * *